US007905767B2

(12) United States Patent
Blatz

(10) Patent No.: US 7,905,767 B2
(45) Date of Patent: Mar. 15, 2011

(54) POWER TOOL WITH OUTPUT SHAFT

(75) Inventor: Thomas Blatz, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 443 days.

(21) Appl. No.: 12/151,031

(22) Filed: May 1, 2008

(65) Prior Publication Data

US 2008/0280547 A1 Nov. 13, 2008

(30) Foreign Application Priority Data

May 2, 2007 (DE) ..... 10 2007 000 252

(51) Int. Cl.
*B24B 23/02* (2006.01)

(52) U.S. Cl. ..... 451/359; 125/13.01

(58) Field of Classification Search ..... 451/359; 125/13.01; 144/136.95, 222, 237
See application file for complete search history.

(56) References Cited

U.S. PATENT DOCUMENTS

| | | | | | |
|---|---|---|---|---|---|
| 1,883,392 | A | * | 10/1932 | Moll | 144/136.1 |
| 4,343,214 | A | * | 8/1982 | Schadlich | 83/543 |
| 4,810,139 | A | * | 3/1989 | Regan | 408/239 A |
| 4,850,109 | A | * | 7/1989 | Kerwin | 30/122 |
| 5,303,754 | A | * | 4/1994 | Rautio | 144/237 |
| 6,813,837 | B1 | * | 11/2004 | Chen | 30/272.1 |
| 7,137,329 | B1 | * | 11/2006 | Moser | 83/543 |

* cited by examiner

*Primary Examiner* — Maurina Rachuba
(74) *Attorney, Agent, or Firm* — Abelman, Frayne & Schwab

(57) ABSTRACT

A motorized power tool includes an output shaft (11) including a tool receptacle (13) for receiving a disc-shaped tool (7) and having an outer thread with a constant outer diameter (D) and that forms a first securing element (14) for a locking element (8), a centering section (16) adjoining the tool receptacle (13) and extending beyond a radial projection of the tool receptacle, and a second securing element (15) provided at the free end (12) of the output shaft (11) for receiving an attachment element (9) for securing a shaft extension (21) to the output shaft (11).

2 Claims, 2 Drawing Sheets

POWER TOOL WITH OUTPUT SHAFT

BACKGROUND OF THE INVENTION

1. Field of the Invention

The present invention relates to a motorized power tool with an output shaft including a tool receptacle proceeding from a free end of the output shaft for receiving a disc-shaped tool and having an outer thread that forms a first securing element for locking means and centering section adjoining the tool receptacle and extending beyond a radial projection of the tool receptacle.

2. Description of the Prior Art

Motorized power tools such as angle grinders or slitting tools, have an output shaft with a tool receptacle and on which a disc-shaped tool, such as a slitting disc, is secured with a locking element such as a locking nut or a locking screw. In order to be able to mount on the output shaft of such a tool simultaneously more than one disc-shaped tool, the power tool is provided with an elongated output shaft as disclosed, e.g., in U.S. Pat. No. 5,303,754. The output shaft has, proceeding from the shaft free end, first section with a tool receptacle in form of a coaxially extending inner thread, and a centering section projecting beyond the radial projection of the tool receptacle.

For mounting of several disc-shaped tools, a hollow cylindrical shaft extension is provided. The shaft extension is secured to the output shaft with a locking element-forming locking screw engaging in the inner thread of the tool receptacle. The shaft extension is pushed onto the output shaft and has, to this end, a first section the inner diameter of which is adapted to the outer diameter of the first section of the output shaft, and a second section that surrounds an end region of the centering section adjacent to the first section of the output shaft.

The drawback of the power tool of U.S. Pat. No. 5,303,754 consists in that in hand-held power tools which inbetween are used with one disc-shaped tool, the large, projecting beyond the disc plane, section of the output shaft limits the possible application region of a power tool.

German Publication DE 871 198 discloses a motorized power tool, the output shaft of which has a proceeding from the shaft free end, tool receptacle having a securing element-forming outer thread, and a centering section adjoining the tool receptacle and projecting beyond the diameter of the outer thread. A disc-shaped tool is secured on the output shaft with locking means-forming locking nut that is screwed onto the outer thread. In order to mount more than one disc-shaped tool on the output shaft, a hollow cylindrical shaft extension is secured on the output shaft. The shaft extension has, at one end, an inner thread engageable with the outer thread of the output shaft. In the end region of the second end of the shaft extension, there is provided an outwardly projecting flange that secures, on the output shaft, a plurality of parallel, spaced from each other, disc-shaped tools, with spacers provided between the disc-shaped tools.

The drawback of the power tool, which is disclosed in the above-discussed German publication, consists in that the shaft extension is guided over the connection section only along mutually engaging threaded sections. With large distances between the disc-shaped tools or with arrangement of several disc-shaped tools on the output shaft, an axial alignment of the shaft extension with respect to the rotational axis of the output shaft cannot be insured. The misalignment can lead to imbalance and, thus, to an imprecise cut. In addition, during an operation, the locking means can become loose or be almost unreleasably tightened.

Accordingly, an object of the present invention is a motorized power tool with an output shaft that would insure a reliable alignment of a shaft extension with the rotational axis of the output shaft upon mounting of the shaft extension on the output shaft, independent from distances between separate disc-shaped tools and/or the number of disc-shaped tools to be mounted on the output shaft.

Another object of the present invention is an output shaft for a motorized power tool that while having a short length, would insure a reliable alignment of the shaft extension, independent of the number of the disc-shaped tools and distances therebetween.

A further object of the present invention is an output shaft for a motorized hand-held power tool that would provide for an easy modification of the power tool from a single disc tool arrangement to a multiple disc tool arrangement, while insuring formation of a precise cut.

SUMMARY OF THE INVENTION

These and other objects of the present invention, which will become apparent hereinafter, are achieved by providing an output shaft in which the outer thread of the tool receptacle has a constant outer diameter, and a second securing element is provided at the free end of the output shaft for receiving attachment means for securing a shaft extension to the output shaft.

A conventional locking nut can be arranged on an outer thread with a constant outer diameter. Simultaneously, the radially outer sections of the outer thread form, in addition to the centering section, an additional guide on the output shaft for the shaft extension which is pushed over the output shaft. The length of a section of the output shaft that projects from the housing of the power tool corresponds essentially to the length of a projecting section of an output shaft for a motorized power tool with a single disc-shaped tool.

Advantageously, the outer thread that forms the first securing element is formed as a flat thread having flat radially outer sections. A conventional locking nut which, e.g., has an inner triangular thread, can be mounted on such flat thread. Simultaneously, the flat outer radial sections of the flat thread form an advantageous guide for the shaft extension which is being pushed over the output shaft. E.g., if in a first step, the outer thread is formed on the output shaft as a triangular thread and then is ground to a predetermined outer diameter, there is provided a flat thread the outer diameter of which lies between two nominal diameters of the thread. Thus, a precise flat thread that enables a precise arrangement of the shaft extension is provided.

Advantageously, the second securing element is formed as an inner thread formed in a central bore provided in the output shaft. Thereby, a locking screw can be used as an attachment element for the shaft extension.

Advantageously, there is provided a hollow cylindrical shaft extension securable on the output shaft and having a first guide section abuttingly supportable on the centering section of the output shaft in a mounted condition of the shaft extension on the output shaft, and a second guide section adjoining the first guide section and abutting by supportable on the first securing element-forming thread. The shaft extension is secured to the output shaft with an attachment element that cooperates with the second securing element of the output shaft. The shaft extension is properly guided over the output shaft despite a short length of the projecting section of the output shaft. This noticeably improves the quality of a produced cut even with large distances between the disc-shaped tools or with several disc-shaped tools arranged on the output shaft parallel to each other.

Advantageously, the output shaft has adjacent to the centering section 16, at least one flat, and the shaft extension is provided at a free end of the first guide section with at least one cam abuttingly engaging the at least one flat for preventing rotation of the shaft extension relative to the output shaft. Thereby, an undesirable loosening or unreleasable tightening of locking means is prevented. It is particularly advantageous to provide two flats adjacent to the centering section on the output shaft, with the shaft extension being provided, at the free end of the first guide section, with two cams for abuttingly engaging the two flats on the output shaft.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
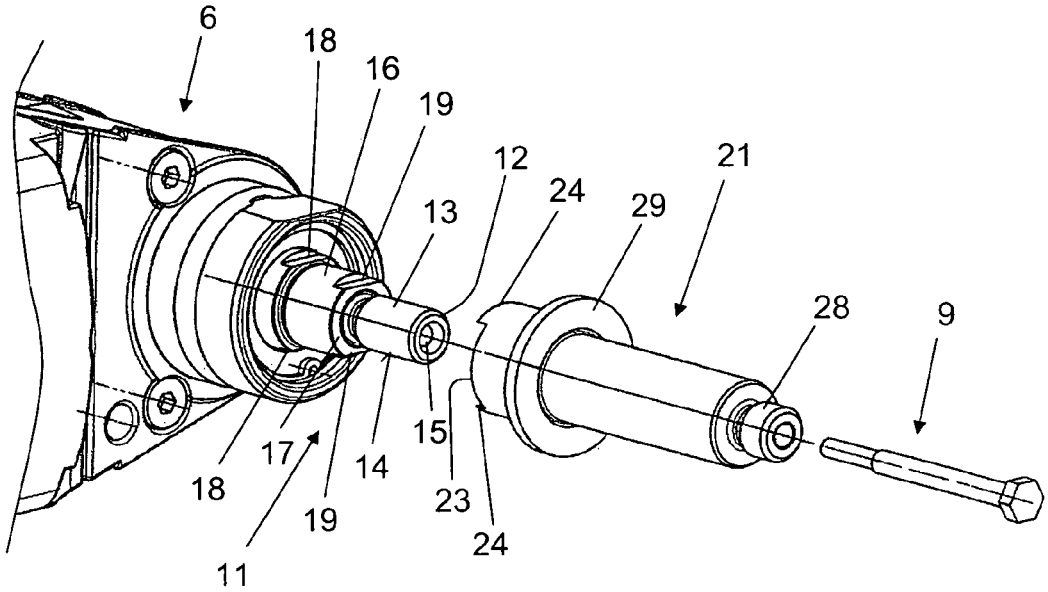
FIG. 1 a perspective exploded view of output shaft according to the present invention, of a shaft extension, and of an attachment screw.

A motor-driven power tool 6, which is partially shown in FIG. 1 and is formed, e.g., as an angle grinder, includes an output shaft 11. The output shaft 11 has, proceeding from its free end 12, a tool receptacle 13 for a disc-shaped tool 7 such as, e.g., a slitting disc. The tool receptacle 13 has an outer thread that forms a first securing element 14 for locking means 8. The output shaft 11 further has a centering section 16 that adjoins the tool receptacle 13 and projects beyond the radial projection of the tool receptacle 13. The outer thread that forms the first securing element 14 has a constant outer diameter D and is formed as a flat thread with flat, lying radially outwardly, sections. At the free end 12 of the output shaft 11, there is provided a second securing element 15 for an attachment element 9 for attachment of a shaft extension 21. The second securing element 15 is formed as an inner thread provided in a central bore of the output shaft 11.

Figure 2:
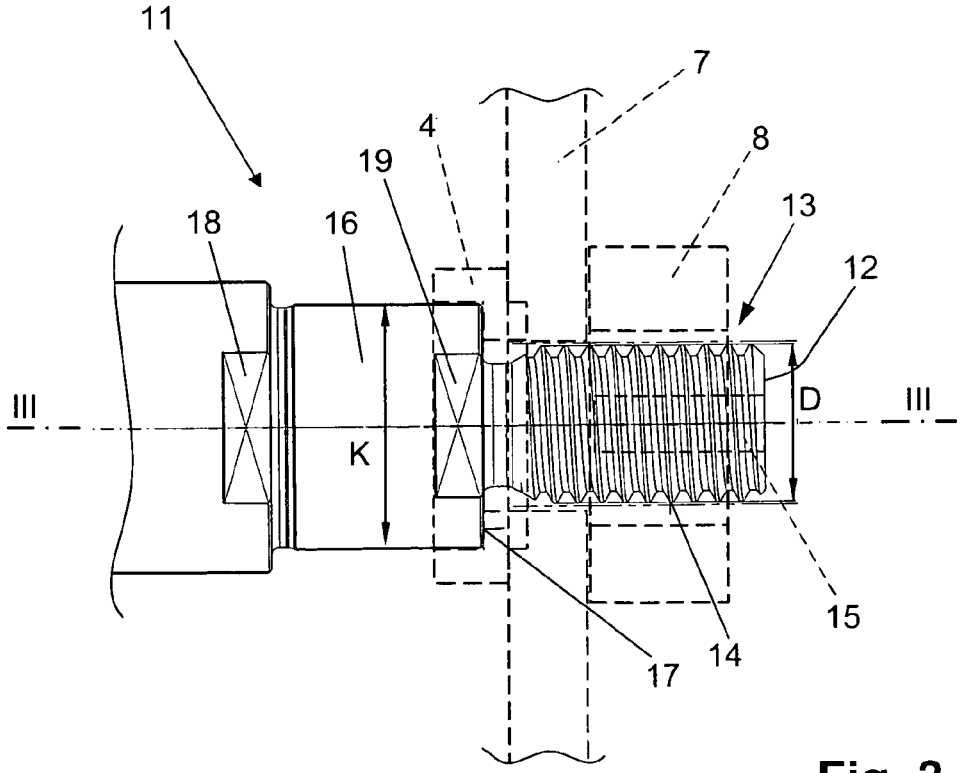
FIG. 2 a side partial view of the output shaft according to the present invention.

In FIG. 2, the arrangement of the disc-shaped tool 7 on the output shaft 11 is shown with dash lines. The disc-shaped tool 7 is guided over the tool receptacle 13 until it abuts an attachment flange 4. The attachment flange 4 abuts, in a mounted condition, an axial stop 17 formed by the centering section 16 that, as it has already indicated above, projects radially beyond the tool receptacle 13. The disc-shaped tool 7 is secured on the output shaft with a conventional locking nut that forms the locking means 8 and is screwed on the first securing element 14.

On the output shaft 11, adjacent to the centering section 16, there are provided two opposite flats 18. The centering section 16 also has, on its end region adjacent to the tool receptacle, two opposite flats 19 engageable with an auxiliary tool, such as a spanner, for releasing the tightened locking means 8. The attachment flange 4 has advantageously entrain surfaces engageable with flats 19 on the centering section 16 for preventing the attachment flange 4 from rotation relative to the output shaft 11.

Figure 3:
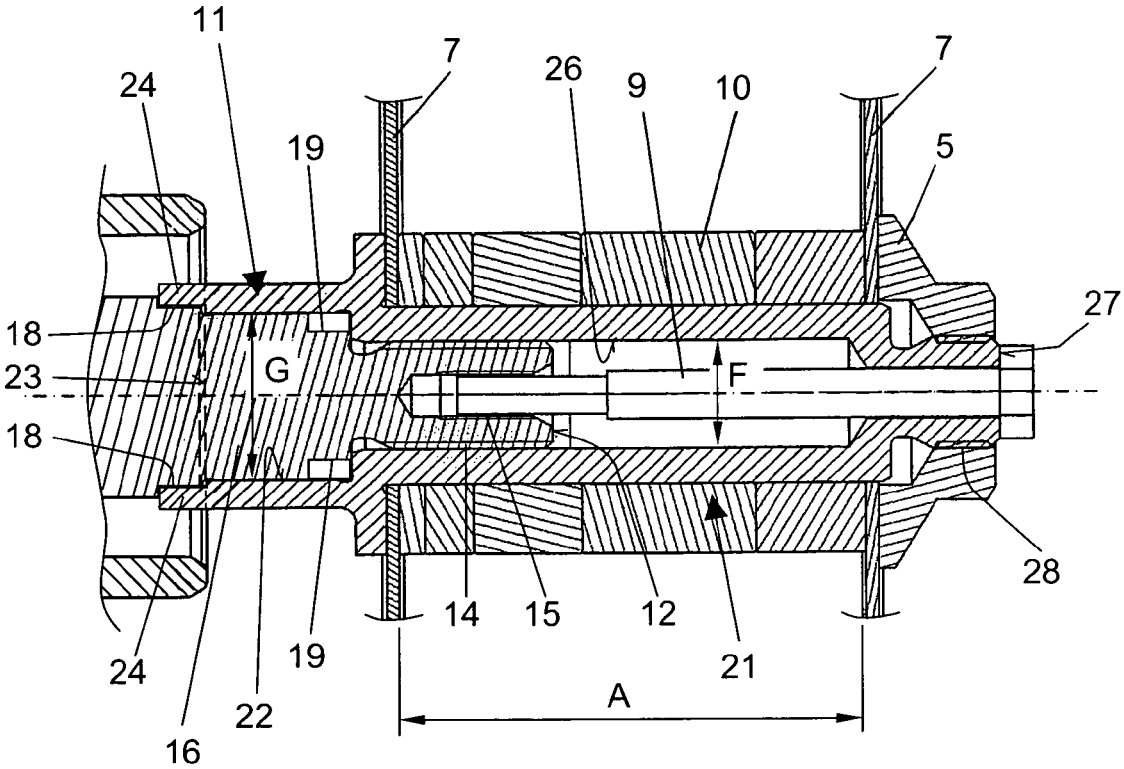
FIG. 3 a longitudinal cross-sectional view of the output shaft with the attached shaft extension along line III-III in FIG. 2.

In order to be able to use the power tool 6 with two or more disc-shaped tools 7 simultaneously mounted on the output shaft 11 for forming, e.g., slots in a constructional component, there is provided a hollow cylindrical shaft extension 21 (see in particular FIG. 3). The shaft extension 21 has a first guide section 22 engageable with the centering section 16 of the output shaft 11, and a second guide section 26 that adjoins the first guide section 22. The second guide section 26 is engageable with flat radial sections of the square thread of the first securing element 14 of the output shaft 11. The shaft extension 21 is secured to the output shaft 11 by a locking screw that forms the attachment element 9 cooperating with the second securing element 15 of the output shaft 11.

The shaft extension 21 has, at the free end 23 of the first guide section 22, two cams 24 which engage, in the attached condition of the shaft extension 21 to the output shaft 11, the flats 18 which are provided on the output shaft 11 adjacent to the centering section 16 to prevent rotation of the shaft extension 21 relative to the output shaft 11.

The inner diameter F of the second guide section 26 of the shaft extension 21 corresponds to the outer diameter D of the square thread that forms the first securing element 14 of the tool receptacle. The inner diameter G of the first guide section 22 of the shaft extension 21 correspond or is adapted to the outer diameter K of the centering section 16 of the output shaft 16. Because the first securing element 14 is formed as a square thread with a constant diameter D, the shaft extension 21 is adequately guided over the output shaft 21 despite a short length of a portion of the output shaft 16 projecting from the power tool 6. This is because the shaft extension 21 is guided by the centering section 16 and the tool receptacle 13.

At the free end 27 of the second guide section 26, there is provided a locking element 5 in form of an outer thread 28 for mounting a locking nut. The shaft extension 21 further has, in the transitional region between the first guide section 22 and the second guide section 26 and outwardly radially projecting collar 29 that forms an axial stop for the disc-shaped tool 7 or a spacer 10.

To modify the power tool 6 from a one disc angle grinder, e.g., to a slitting tool with two, extending parallel to each other and at a distance from each other, disc-shaped tools 7, firstly, the shaft extension 21 is pushed with the free end 23 of the first guide section 22 over the free end 12 of the output shaft 11 until it abuts an axial stop 17 of the output shaft 11 between the tool receptacle 13 and the centering section 16. In this position of the shaft extension 21, the extension cams 24 of the shaft extension 21 engage the flats 18 of the output shaft 11, which are located adjacent to the centering section 16. This insures a joint rotation of the shaft extension 21 with the output shaft 11 in the mounted condition of the shaft extension 21 on the output shaft 11. The shaft extension 21 is secured on the output shaft 11 with the attachment element 9 that engages in the second securing element 15 of the output shaft 11. Finally, a first slitting disc, the disc-shaped tool 7, is pushed over the shaft extension 21. In accordance with a desired distance A between the two disc-shaped tools 7, a number of spacers 10 are used, and then the second disc-shaped tool 7 is pushed onto the shaft extension 21. With a locking nut that forms the locking element 5, the disc-shaped tools 7 are secured on the shaft extension 21 and, thereby, on the output shaft 11.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A motorized power tool assembly, comprising an output shaft (11) including a tool receptacle (13) proceeding from a free end (12) of the output shaft (11) for receiving a disc-shaped tool (7) and having an outer thread with a constant outer diameter (D) and forming a first securing element (14) for locking means (8), and a centering section (16) adjoining the tool receptacle (13) and extending beyond a radial projection of the receptacle (13);

a hollow cylindrical shaft extension (21) securable on the output shaft (11) and having a first guide section (22) abuttingly supportable on the centering section (16) of the output shaft (11) in a mounted condition of the shaft extension (21) on the output shaft (11) and a second guide section (26) adjoining the first guide section (22) and abuttingly supportable on the first securing element-forming outer thread; and attachment means (9) for securing the shaft extension (21) on the output shaft (11), the output shaft (11) having a second securing element (15) provided at the free end (12) of the output shaft (11) for receiving the attachment means (9).

2. A motorized power tool assembly according to claim 1, wherein the output shaft (11) has adjacent to the centering section (16) at least one spanner flat (18), and the shaft extension (21) is provided at a free end (23) of the first guide section (22) with at least one cam (24) abuttingly engaging the at least one spanner flat (18) for preventing rotation of the shaft extension (21) relative to the output shaft (11).

* * * * *